US011609591B2

(12) United States Patent
Lu

(10) Patent No.: US 11,609,591 B2
(45) Date of Patent: Mar. 21, 2023

(54) REFERENCE CIRCUIT WITH TEMPERATURE COMPENSATION

(71) Applicant: Hycon Technology Corp., Taipei (TW)

(72) Inventor: Chun-Yao Lu, Taipei (TW)

(73) Assignee: Hycon Technology Corp., Taipei (TW)

( * ) Notice: Subject to any disclaimer, the term of this patent is extended or adjusted under 35 U.S.C. 154(b) by 155 days.

(21) Appl. No.: 17/172,136

(22) Filed: Feb. 10, 2021

(65) Prior Publication Data

US 2022/0253085 A1 Aug. 11, 2022

(51) Int. Cl.
*G05F 3/24* (2006.01)
*G05F 1/46* (2006.01)

(52) U.S. Cl.
CPC ..... *G05F 3/245* (2013.01); *G05F 1/468* (2013.01)

(58) Field of Classification Search
CPC ..... G05F 3/245; G05F 1/468
USPC ..... 323/313
See application file for complete search history.

(56) References Cited

U.S. PATENT DOCUMENTS 6,496,057 B2 * 12/2002 Wada ..... G05F 1/465 327/543
2011/0121809 A1 * 5/2011 Camacho Galeano ..... G05F 3/262 323/313

* cited by examiner

*Primary Examiner* — Yemane Mehari
(74) *Attorney, Agent, or Firm* — Demian K. Jackson; Jackson IPG PLLC

(57) ABSTRACT

The present invention discloses a reference circuit with temperature compensation, which is characterized in that a current output circuit is designed to receive a reference voltage from a bias voltage generation circuit, generate two reference currents with opposite temperature variation characteristics, and then merge them into a compensated current with temperature compensation. In addition, a voltage output circuit is designed to receive a reference voltage from a bias voltage generation circuit, which includes several field-effect transistors operating in saturation regions, and a precision voltage increases with threshold voltages of the field-effect transistors to compensate for the temperature variation. Resistors can be incorporated or sizes of the field effect transistors can be changed to adjust the output current, output voltage or the temperature variation characteristics.

19 Claims, 7 Drawing Sheets

REFERENCE CIRCUIT WITH TEMPERATURE COMPENSATION

FIELD OF THE INVENTION

The present invention relates to a reference circuit. More specifically, the present invention relates to a reference circuit with temperature compensation, which can output a stable voltage and current under temperature variations.

BACKGROUND OF THE INVENTION

Reference circuits are widely used in various electronic components to provide accurate voltage or current. For example, a comparator needs an accurate reference voltage as a comparison reference. Also, accurate reference voltage and reference current are necessary for impedance match in high-speed input and output circuits, USB interfaces, and SATA interfaces. The ideal reference voltage and reference current are stable and would not change with the process, temperature, and power supply voltage. In addition, the lower the power consumption of the reference circuit, the better.

Taiwan Patent No. I367412 discloses a reference circuit which provides both compensated voltage and compensated current, and uses a differential voltage reference circuit, a positive temperature coefficient correction circuit, a threshold voltage superposition circuit, and a precision current generation circuit to compensate for the temperature variations. However, the differential voltage reference circuit needs to use bipolar junction transistors (BJTs), which consume more power than field effect transistors. In addition, the positive temperature coefficient correction circuit includes an operational amplifier, which requires a larger circuit area.

Taiwan Patent No. 1485546 discloses a reference circuit for providing a compensated voltage by use of only several of field effect transistors and two resistors. However, it does not provide compensated current. In addition, there is a resistor directly connected between an output voltage and ground, which requires a large resistance or current to output a higher compensated voltage. This would increase circuit area or power consumption, and introduce more noise interferences.

Taiwan Patent No. I521325 discloses a reference circuit for providing a compensated voltage and a compensated current, by use of only several multiple field effect transistors and three resistors. However, the compensated voltage and the compensated current cannot be adjusted separately. In addition, the same disadvantage as Taiwan Patent No. I485546 invention patent is a resistor directly connected between an output voltage and ground, which requires a large resistance or current to output a higher compensated voltage. This would increase circuit area or power consumption, and introduce more noise interferences. In view of the above problems, the present invention discloses a reference circuit for generating both of a compensated voltage and a compensated current, and the compensated voltage, the compensated current and temperature variation characteristics can be adjusted separately while the circuit area is small and the power consumption is low.

SUMMARY OF THE INVENTION

The present invention discloses a reference circuit with temperature compensation, comprising a bias generation circuit and a current output circuit. The bias generation circuit generates a first reference voltage and a second reference voltage. The current output circuit receives the first reference voltage by means of a field effect transistor, generates a first reference current having similar temperature variation characteristics to a current from the bias generation circuit, and receives the second reference voltage by means of a plurality of field effect transistors and a resistor. The plurality of field effect transistors are operated in saturation region and generate a second reference current which has a value increasing with threshold voltages of the plurality of field effect transistors, and has temperature variation characteristics contrary to those of the current from the bias generation circuit. The first reference current and the second reference current are merged into a compensated current with temperature compensation. Namely, if the current from the bias generation circuit increases/decreases with temperature, the first reference current would increase/decrease with temperature, too. However, the variation amounts thereof won't be necessarily identical.

In the reference circuit with temperature compensation, the bias generation circuit comprises: a first resistor having one terminal grounded; a first n-type field effect transistor having a source connected to another terminal of the first resistor; a second n-type field effect transistor having a source grounded, a gate and a drain both connected to a gate of the first n-type field effect transistor; a third n-type field effect transistor having a source connected to a drain of the first n-type field effect transistor; a fourth n-type field effect transistor having a source connected to the drain of the second n-type field effect transistor, a gate and a drain both connected to a gate of the third n-type field effect transistor; a first p-type field effect transistor having a source connected to a power source, a gate and a drain both connected to a drain of the third n-type field effect transistor; and a second p-type field effect transistor having a source connected to the power source, a gate connected to the gate of the first p-type field effect transistor and a drain connected to the drain of the fourth n-type field effect transistor. A gate voltage of the first p-type field effect transistor is the first reference voltage, and a gate voltage of the third n-type field effect transistor is the second reference voltage.

In the reference circuit with temperature compensation, the current output circuit comprises: a fifth p-type field effect transistor having a source connected to a power source, a gate connected to the first reference voltage and a drain for generating a first reference current; a sixth n-type field effect transistor having a gate connected to the second reference voltage; a second resistor having one terminal grounded and another terminal connected to a source of the sixth n-type field effect transistor; a sixth p-type field effect transistor having a source connected to the power source, a gate and a drain both connected to a drain of the sixth n-type field effect transistor; and a seventh p-type field effect transistor having a source connected to the power source, a gate connected to the gate of the sixth p-type field effect transistor, and a drain which generates a second reference current and is connected to the drain of the fifth p-type field effect transistor.

In the reference circuit with temperature compensation, the fifth p-type field effect transistor, the sixth p-type field effect transistor or the seventh p-type field effect transistor can be changed in dimension to adjust value of the first reference current or the second reference current, thereby adjusting value of the compensated current and the temperature variation characteristics.

The reference circuit with temperature compensation further comprises a voltage output circuit having a plurality of field effect transistors for receiving the first reference voltage or the second reference voltage and generating a compensated voltage. The plurality of field effect transistors are operated in saturation region and the compensated voltage increases with threshold voltages of the plurality of field effect transistors to compensate for temperature variations.

In the reference circuit with temperature compensation, the voltage output circuit comprises: an eighth p-type field effect transistor having a source connected to the power source, and a gate connected to the first reference voltage; and a metal-oxide semiconductor (MOS) transistor, in which the MOS transistor is an eighth n-type field effect transistor having a source grounded, a gate and a drain both connected to a drain of the eighth p-type field effect transistor, or the MOS transistor is a ninth p-type field effect transistor having a source connected to a drain of the eighth p-type field effect transistor, a gate and a drain both grounded; wherein the compensated voltage being taken between the eighth p-type field effect transistor and the MOS transistor.

In the reference circuit with temperature compensation, the voltage output circuit further comprises a third resistor connected between the eighth p-type field effect transistor and the MOS transistor, or connected between the MOS transistor and the ground, or connected between the gate and drain of the eighth n-type field effect transistor, wherein resistance of the third resistor and dimension of the eighth n-type field effect transistor or the ninth p-type field effect transistor can be changed, thereby changing value of the compensated voltage.

The present invention discloses a reference circuit with temperature compensation, comprising: a bias generation circuit for generating a first reference voltage; and a voltage output circuit including a plurality of field effect transistors for receiving the first reference voltage and generating a compensated voltage. The plurality of field effect transistors are operated in saturation region, and the compensated voltage increases with threshold voltages of the plurality of field effect transistors to compensate for temperature variations.

In the reference circuit with temperature compensation, the bias generation circuit comprises: a first resistor having one terminal grounded; a first n-type field effect transistor having a source connected to another terminal of the first resistor, a gate and a drain; a second n-type field effect transistor having a source grounded, a gate and a drain both connected to the gate of the first n-type field effect transistor; a first p-type field effect transistor having a source connected to a power source, a gate and a drain both connected to the drain of the first n-type field effect transistor; and a second p-type field effect transistor having a source connected to the power source, a gate connected to the gate of the first p-type field effect transistor, and a drain connected to the drain of the second n-type field effect transistor. A gate voltage among the field effect transistors is the first reference voltage.

In the reference circuit with temperature compensation, the bias generation circuit further comprises: a third n-type field effect transistor having a source and a drain connected between the first n-type field effect transistor and the first p-type field effect transistor; and a fourth n-type field effect transistor having a source, a drain connected between the second n-type field effect transistor and the second p-type field effect transistor, and a gate connected to the drain of the second p-type field effect transistor and a gate of the third n-type field effect transistor.

In the reference circuit with temperature compensation, the voltage output circuit comprises: an eighth p-type field effect transistor having a source connected to the power source and a gate connected to the first reference voltage; and an eighth n-type field effect transistor having a source grounded, a gate and a drain both connected to a drain of the eighth p-type field effect transistor, with the compensated voltage being taken between the eighth p-type field effect transistor and the eighth n-type field effect transistor. The eighth n-type field effect transistor can be replaced with a ninth p-type field effect transistor, having a source connected to the drain of the eighth p-type field effect transistor, a gate and a drain both grounded.

In the reference circuit with temperature compensation, wherein the voltage output circuit further comprises a third resistor connected between the eighth p-type field effect transistor and the eighth n-type field effect transistor, between the eighth p-type field effect transistor and the ninth p-type field effect transistor, or between the gate and drain of the eighth n-type field effect transistor. Resistance of the third resistor and dimension of the eighth n-type field effect transistor or the ninth p-type field effect transistor can be changed, thereby changing value of the compensated voltage.

The reference circuit with temperature compensation has an advantage of good power supply voltage rejection ratio (PSRR), which means that when the power supply is interfered by noises, the outputted reference voltage variation is relatively small. In addition, it has a wide operating range for the power supply voltage within the commonly used range of 1.8V to 5.5V, and the outputted reference voltage and reference current can be adjusted. For example, the commonly used reference voltage is 1.2V, and the outputted reference voltage can be adjusted to the threshold voltage (Vth) of the field effect transistor approximately. In addition, this configuration can be implemented with only field effect transistors. Compared with the prior arts which require bipolar junction transistors (BJTs), the present invention has simpler process, smaller circuit area and lower power consumption.

This paragraph extracts and compiles some features of the present invention; other features will be disclosed in the follow-up paragraphs. It is intended to cover various modifications and similar arrangements included within the spirit and scope of the appended claims.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

The present invention will be described more specifically with reference to the following embodiments. Please note that the following description of the embodiments of the present invention is limited to the purpose of description. The present invention is not limited to the disclosed forms.

Figure 1:
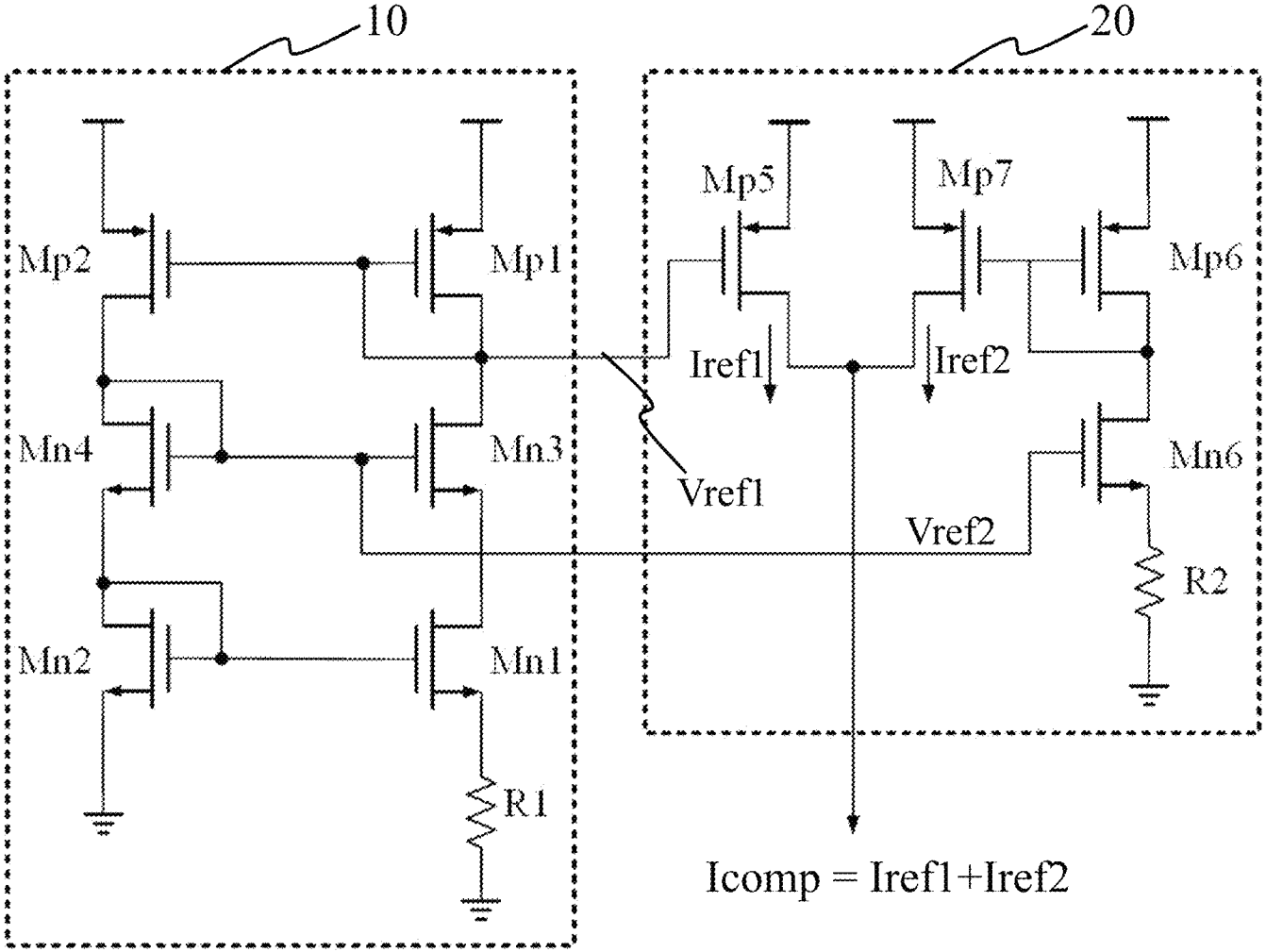
FIG. 1 is a diagram showing a current reference circuit with temperature compensation according to a first embodiment of the present invention.

FIG. 1 shows a current reference circuit with temperature compensation according to a first embodiment of the present invention, including a bias generation circuit 10 and a current output circuit 20. The bias generation circuit 10 generates a first reference voltage Vrefl and a second reference voltage Vref2. The current output circuit 20 receives the first reference voltage Vrefl by means of a field effect transistor (fifth p-type field effect transistor Mp5), generates a first reference current Irefl having similar temperature variation characteristics to a current from the bias generation circuit 10, and receives the second reference voltage Vref2 by means of a plurality of field effect transistors (sixth p-type field effect transistor Mp6, seventh p-type field effect transistor Mp7 and sixth n-type field effect transistor Mn6) and a second resistor R2. The plurality of field effect transistors are operated in saturation region and generate a second reference current Iref2 which has a value increasing with threshold voltages (Vth) of the plurality of field effect transistors, and has temperature variation characteristics contrary to those of the current from the bias generation circuit 10. The first reference current and the second reference current are merged into a compensated current Icomp with temperature compensation.

In the reference circuit with temperature compensation, the bias generation circuit 10 comprises: a first resistor R1 having one terminal grounded; a first n-type field effect transistor Mn1 having a source connected to another terminal of the first resistor R1; a second n-type field effect transistor Mn2 having a source grounded, a gate and a drain both connected to a gate of the first n-type field effect transistor Mn1; a third n-type field effect transistor Mn3 having a source connected to a drain of the first n-type field effect transistor Mn1; a fourth n-type field effect transistor Mn4 having a source connected to the drain of the second n-type field effect transistor Mn2, a gate and a drain both connected to a gate of the third n-type field effect transistor Mn3; a first p-type field effect transistor Mp1 having a source connected to a power source, a gate and a drain both connected to a drain of the third n-type field effect transistor Mn3; and a second p-type field effect transistor Mp2 having a source connected to the power source, a gate connected to the gate of the first p-type field effect transistor Mp1 and a drain connected to the drain of the fourth n-type field effect transistor Mn4. A gate voltage of the first p-type field effect transistor Mp1 is the first reference voltage Vrefl, and a gate voltage of the third n-type field effect transistor Mn3 is the second reference voltage Vref2.

In the reference circuit with temperature compensation, the current output circuit 20 comprises: a fifth p-type field effect transistor Mp5 having a source connected to a power source, a gate connected to the first reference voltage Vref1 and a drain for generating a first reference current Iref1; a sixth n-type field effect transistor Mn6 having a gate connected to the second reference voltage Vref2; a second resistor R2 having one terminal grounded and another terminal connected to a source of the sixth n-type field effect transistor Mn6; a sixth p-type field effect transistor Mp6 having a source connected to the power source, a gate and a drain both connected to a drain of the sixth n-type field effect transistor Mn6; and a seventh p-type field effect transistor Mp7 having a source connected to the power source, a gate connected to the gate of the sixth p-type field effect transistor Mp6, and a drain which generates a second reference current Iref2 and is connected to the drain of the fifth p-type field effect transistor Mp5.

In the reference circuit with temperature compensation, a current of the fifth p-type field effect transistor Mp5 is the first reference current Iref1, which has similar temperature variation characteristics to a current from the bias generation circuit 10. That is, the currents increase with higher temperature. A current of the sixth n-type field effect transistor Mn6 and a current through the second resistor R2 are identical and referred to as IR2.

$$VGSN1+VGSN3=VGSN6+(IR2*R2)$$

where VGSN1 represents voltage between gate and source of the first n-type field effect transistor Mn1, VGSN3 for Mn3 and VGSN6 for Mn6. The above equation can be transferred into:

$$I_{R2}=(VGSN1+VGSN3-VGSN6)/R2$$

In case that other parameters are fixed, VGSN1, VGSN3 and VGSN6 increase with threshold voltages (Vth) of the field effect transistors, but the threshold voltages (Vth) decrease with higher temperature. Therefore, current IR2 of the sixth n-type field effect transistor Mn6 and the second resistor R2 decreases with higher temperature, so does the second reference current Iref2 of the sixth p-type field effect transistor Mp6 and the seventh p-type field effect transistor Mp7. To sum up, the first reference current Iref1 and the second reference current Iref2 have opposite temperature variation characteristics, such that the merged compensated current Icomp has temperature compensation.

In the reference circuit with temperature compensation, the fifth p-type field effect transistor Mp5, the sixth p-type field effect transistor Mp6 or the seventh p-type field effect transistor Mp7 can be changed in dimension, in order to adjust the first reference current Iref1, the second reference current Iref2 and the compensated current Icomp as well as the temperature variation characteristics.

Figure 2:
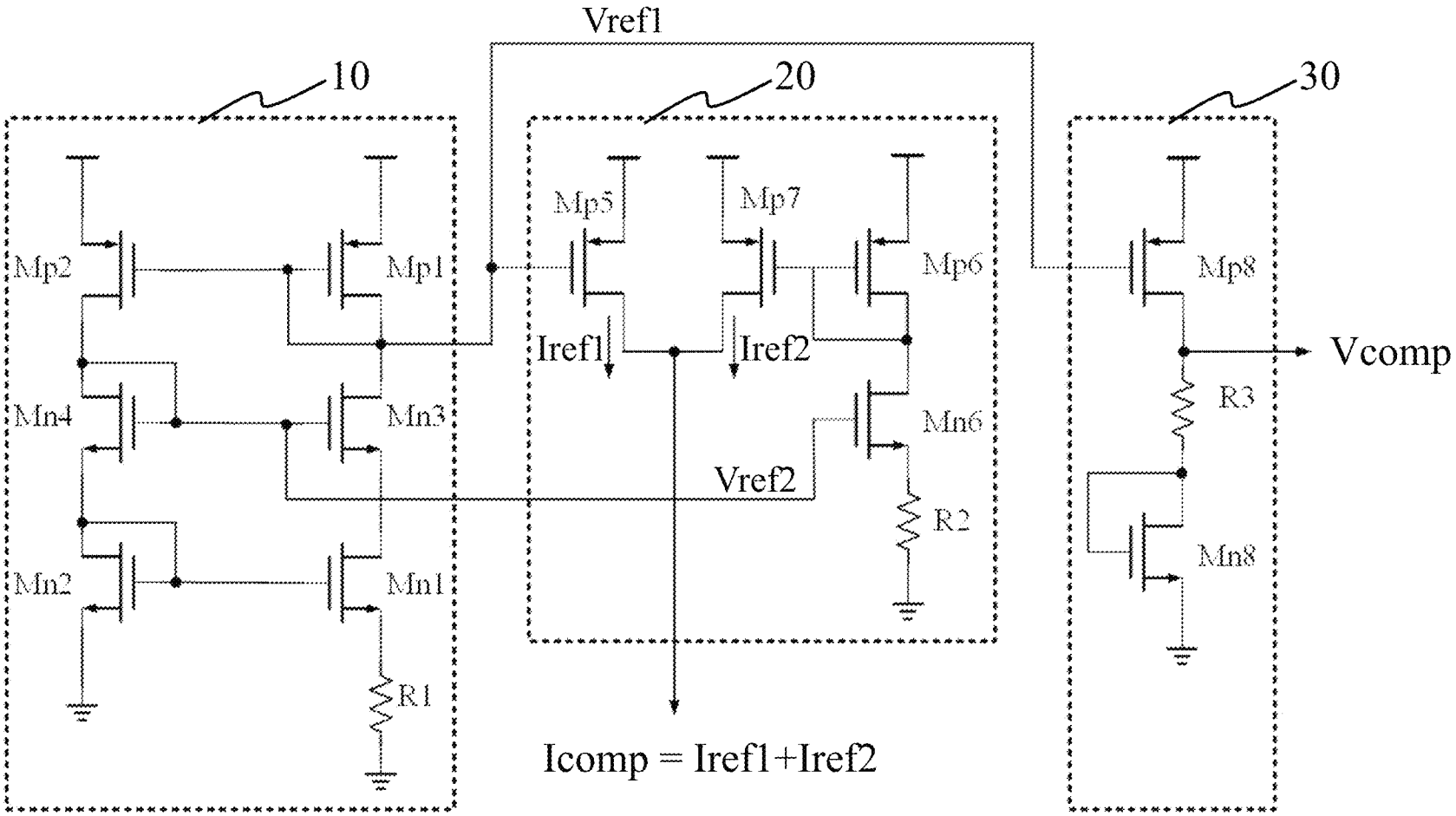
FIG. 2 is a diagram showing a current and voltage reference circuit with temperature compensation.

The reference circuit with temperature compensation further comprises a voltage output circuit 30 for outputting a compensated voltage Vcomp, as shown in FIG. 2. The voltage output circuit 30 comprises a plurality of field effect transistors (eighth p-type field effect transistor Mp8 and eighth n-type field effect transistor Mn8) to receive the first reference voltage Vref1 and generate the compensated voltage Vcomp. The field effect transistors are operated in saturation region, and the compensated voltage Vcomp increases with threshold voltages (Vth) of the field effect transistors to compensate for temperature variations.

In the voltage output circuit 30, if the third resistor R3 is set to be zero (R3=0), the compensated voltage Vcomp is equal to voltage between the gate and source of the eighth n-type field effect transistor Mn8, i.e., VGSN8, which increases with a current from the bias generation circuit 10 and the threshold voltages (Vth) of the field effect transistors. Since the current of the bias generation circuit 10 increases with temperature and the threshold voltages (Vth) of the field effect transistors decreases with temperature, these opposite temperature variation characteristics are combined to compensate for temperature variations. Furthermore, the third resistor R3 can be used to adjust the compensated voltage Vcomp.

Figure 3:
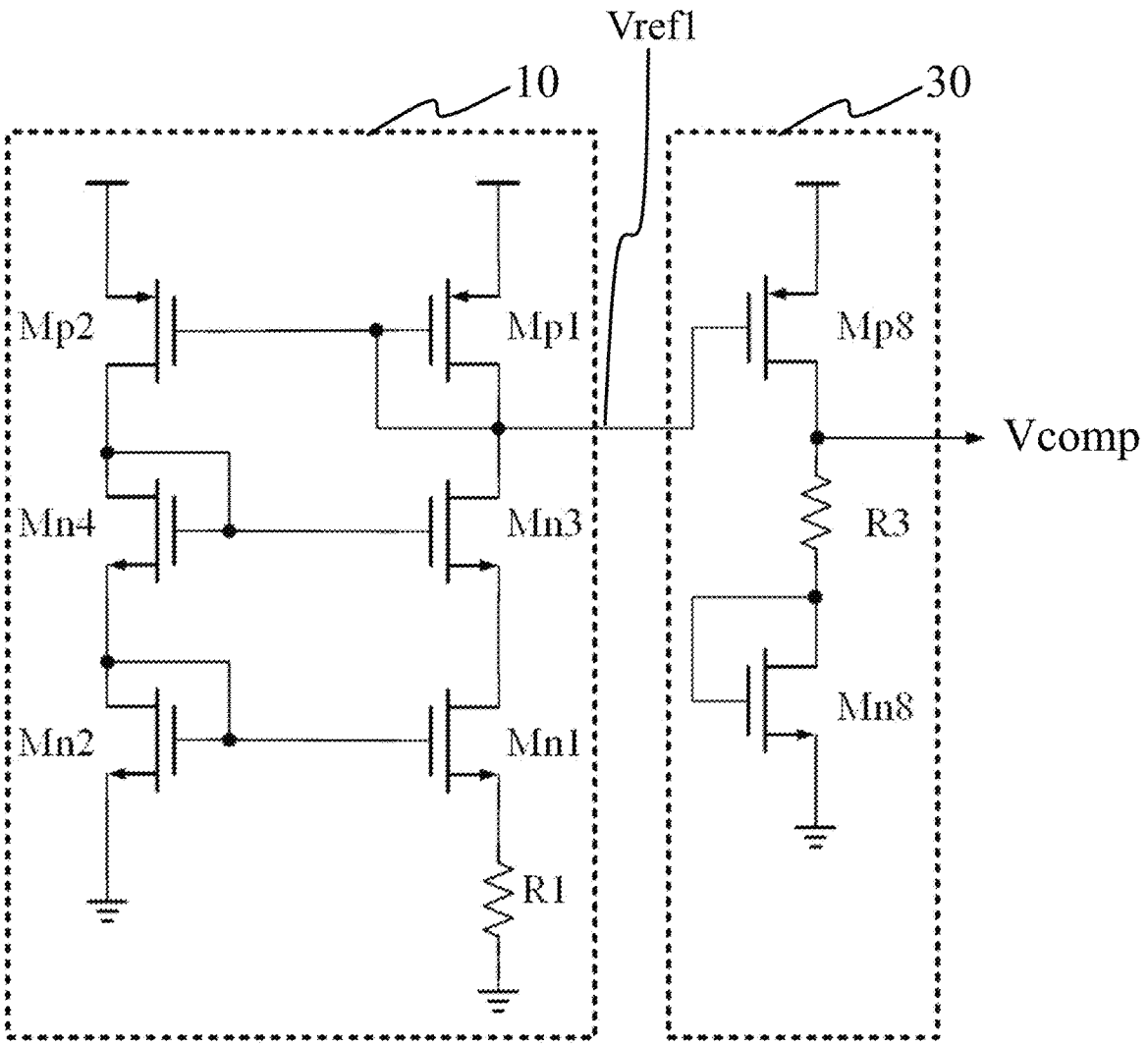
FIG. 3 is a diagram showing a voltage reference circuit with temperature compensation.

FIG. 3 illustrates a third embodiment according to the present invention. As shown, a compensated voltage reference circuit with temperature compensation comprises a bias generation circuit 10 and a voltage output circuit 30. The bias generation circuit 10 and the voltage output circuit 30 are the same as those shown in FIG. 2. FIG. 3 explains how the compensated voltage Vcomp and the compensated current Icomp can be adjusted respectively, and illustrates various configurations for the voltage output circuit 30.

Figure 4:
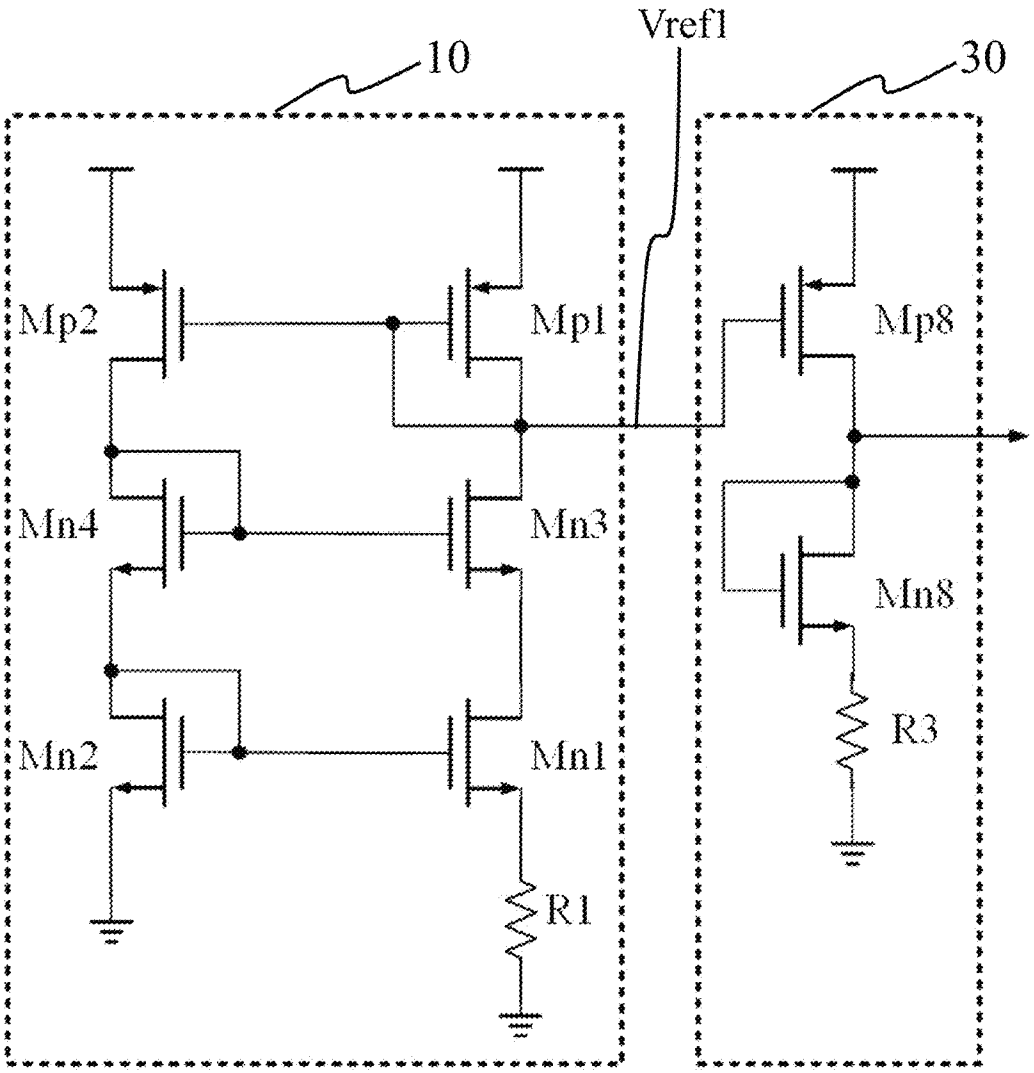
FIG. 4 illustrates an alternative configuration for the voltage output circuit shown in FIG. 3.

FIG. 4 illustrates an alternative configuration for the voltage output circuit 30 shown in FIG. 3, with a difference of location exchange for the eighth n-type field effect transistor Mn8 and the third resistor R3. Temperature variations are also compensated for the compensated voltage Vcomp.

Figure 5:
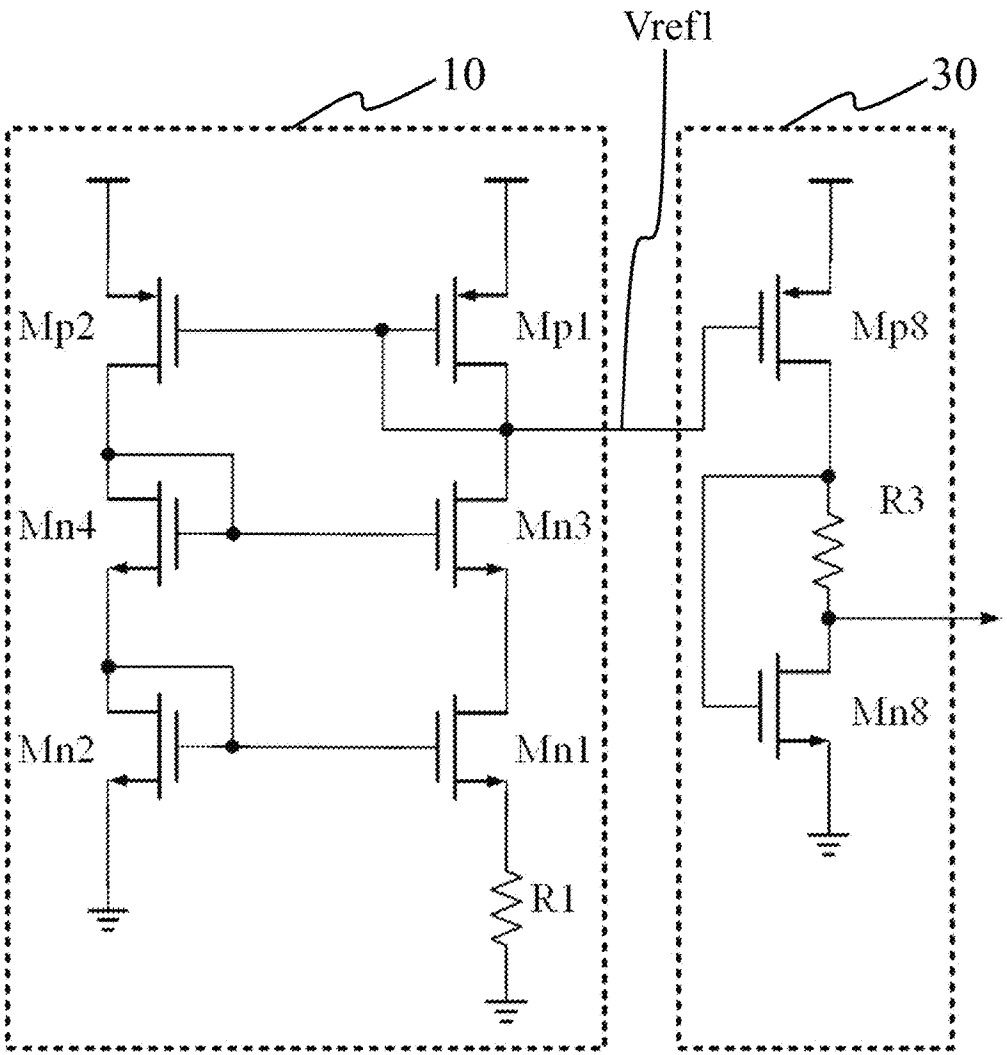
FIG. 5 illustrates another configuration for the voltage output circuit shown in FIG. 3.

FIG. 5 illustrates an alternative configuration for the voltage output circuit 30 shown in FIG. 3, with different connections for the eighth n-type field effect transistor Mn8 and the third resistor R3. In FIG. 5, the eighth n-type field effect transistor Mn8 has a source grounded, a gate connected to a drain of the eighth p-type field effect transistor Mp8, and a drain connected to one terminal of the third resistor R3. The other terminal of the third resistor R3 is connected to the gate of the eighth n-type field effect transistor Mn8. The compensated voltage Vcomp is taken from the drain of the eighth n-type field effect transistor Mn8, and it is provided with temperature compensation.

Figure 6:
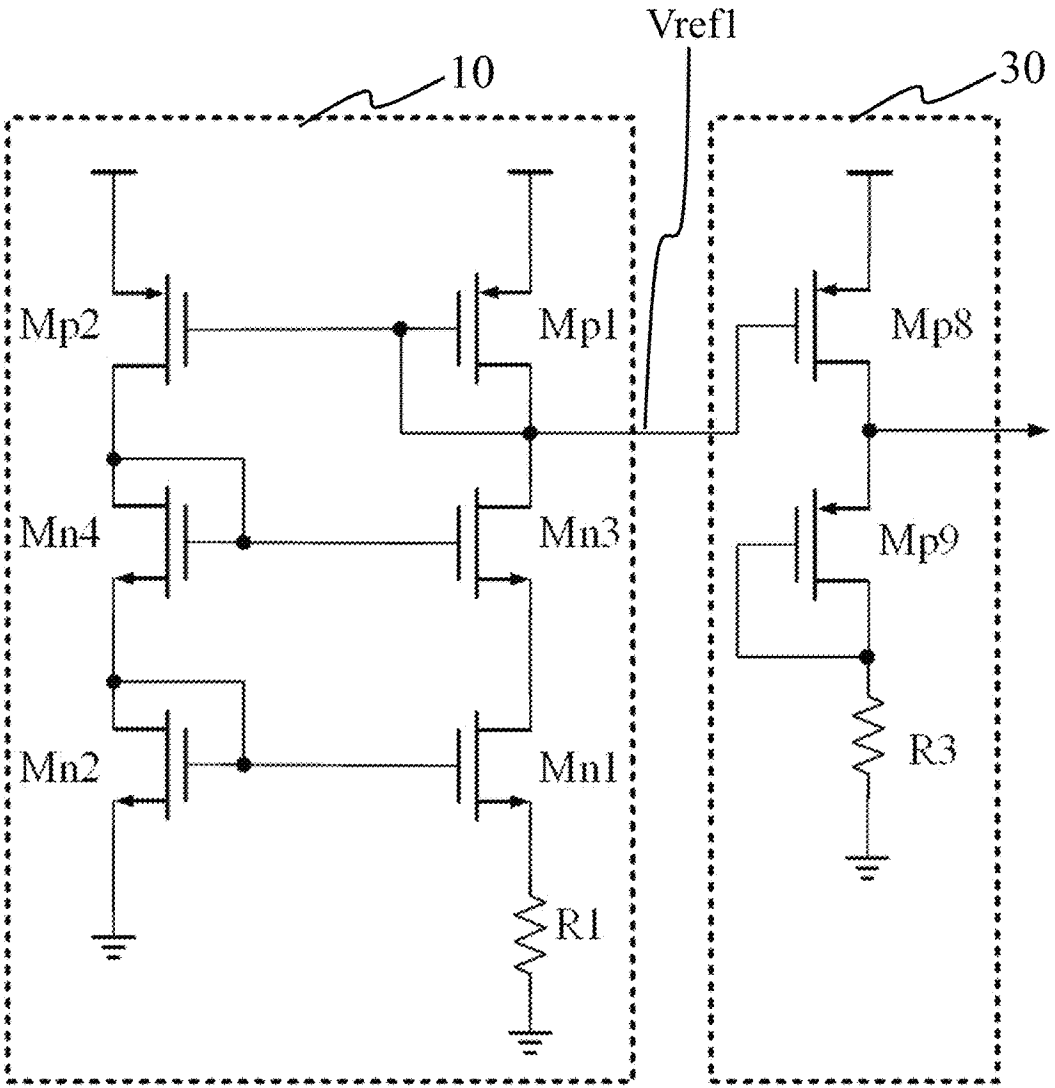
FIG. 6 illustrates an alternative configuration for the voltage output circuit shown in FIG. 4.

FIG. 6 illustrates an alternative configuration for the voltage output circuit 30 shown in FIG. 4, with a difference that the eighth n-type field effect transistor Mn8 is replaced with a ninth p-type field effect transistor Mp9 having a source connected to the drain of the eighth p-type field effect transistor Mp8, a gate and a drain connected to one terminal of the third resistor R3. In addition, the ninth p-type field effect transistor Mp9 can be exchanged with the third resistor R3. According to any of the connections, temperature variations are also compensated for the compensated voltage Vcomp.

Figure 7:
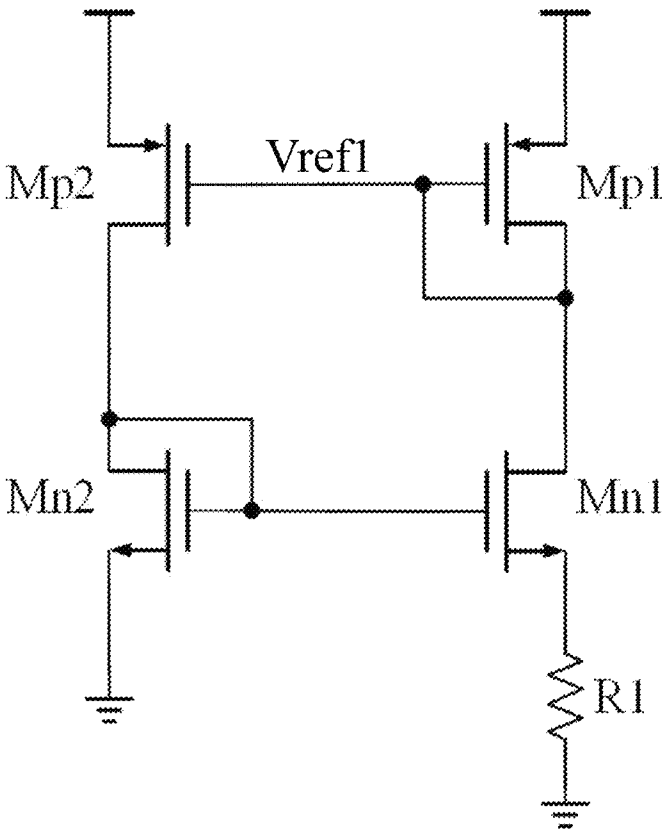
FIG. 7 illustrates an alternative configuration for the bias generation circuit shown in FIG. 3.

FIG. 7 illustrates an alternative configuration for the bias generation circuit 10 shown in FIG. 3. The bias generation circuit 10 comprises: a first resistor R1 having one terminal grounded; a first n-type field effect transistor Mn1 having a source connected to another terminal of the first resistor R1, a gate and a drain; a second n-type field effect transistor Mn2 having a source grounded, a gate and a drain both connected to the gate of the first n-type field effect transistor Mn1; a first p-type field effect transistor Mp1 having a source connected to a power source, a gate and a drain both connected to the drain of the first n-type field effect transistor Mn1; a second p-type field effect transistor Mp2 having a source connected to the power source, a gate connected to the gate of the first p-type field effect transistor Mp1, and a drain connected to the drain of the second n-type field effect transistor Mn2. Gate voltage of the first p-type field effect transistor Mp1 is the first reference voltage Vref1.

In the voltage output circuit 30, resistance of the third resistor R3 can be adjusted, or dimension of the eighth n-type field effect transistor Mn8 or the ninth p-type field effect transistor Mp9 can be varied, in order to change the compensated voltage Vcomp.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims, which are to be accorded with the broadest interpretation so as to encompass all such modifications and similar structures.

What is claimed is:

1. A reference circuit with temperature compensation, comprising:

a bias generation circuit for generating a first reference voltage and a second reference voltage;

a current output circuit for receiving the first reference voltage by means of a field effect transistor, generating a first reference current having similar temperature variation characteristics to a current from the bias generation circuit, and for receiving the second reference voltage by means of a plurality of field effect transistors and a resistor, wherein the plurality of field effect transistors are operated in saturation region and generate a second reference current which has a value increasing with threshold voltages of the plurality of field effect transistors, and has temperature variation characteristics contrary to those of the current from the bias generation circuit, and wherein the first reference current and the second reference current are merged into a compensated current with temperature compensation.

2. The reference circuit according to claim 1, wherein the bias generation circuit comprises:

a first resistor having one terminal grounded;

a first n-type field effect transistor having a source connected to another terminal of the first resistor;

a second n-type field effect transistor having a source grounded, a gate and a drain both connected to a gate of the first n-type field effect transistor;

a third n-type field effect transistor having a source connected to a drain of the first n-type field effect transistor;

a fourth n-type field effect transistor having a source connected to the drain of the second n-type field effect transistor, a gate and a drain both connected to a gate of the third n-type field effect transistor;

a first p-type field effect transistor having a source connected to a power source, a gate and a drain both connected to a drain of the third n-type field effect transistor; and a second p-type field effect transistor having a source connected to the power source, a gate connected to the gate of the first p-type field effect transistor and a drain connected to the drain of the fourth n-type field effect transistor;

wherein a gate voltage of the first p-type field effect transistor is the first reference voltage, and a gate voltage of the third n-type field effect transistor is the second reference voltage.

3. The reference circuit according to claim 1, wherein the current output circuit comprises:

a fifth p-type field effect transistor having a source connected to a power source, a gate connected to the first reference voltage and a drain for generating the first reference current;

a sixth n-type field effect transistor having a gate connected to the second reference voltage;

a second resistor having one terminal grounded and another terminal connected to a source of the sixth n-type field effect transistor;

a sixth p-type field effect transistor having a source connected to the power source, a gate and a drain both connected to a drain of the sixth n-type field effect transistor; and a seventh p-type field effect transistor having a source connected to the power source, a gate connected to the gate of the sixth p-type field effect transistor, and a drain which generates a second reference current and is connected to the drain of the fifth p-type field effect transistor.

4. The reference circuit according to claim 3, wherein the fifth p-type field effect transistor, the sixth p-type field effect transistor or the seventh p-type field effect transistor can be changed in dimension to adjust value of the first reference current or the second reference current, thereby adjusting value of the compensated current and the temperature variation characteristics.

5. The reference circuit according to claim 1, further comprising a voltage output circuit having a plurality of field effect transistors for receiving the first reference voltage or the second reference voltage and generating a compensated voltage, wherein the plurality of field effect transistors are operated in saturation region and the compensated voltage increases with threshold voltages of the plurality of field effect transistors to compensate for temperature variations.

6. The reference circuit according to claim 5, wherein the voltage output circuit comprises:

an eighth p-type field effect transistor having a source connected to the power source, and a gate connected to the first reference voltage; and a metal-oxide semiconductor (MOS) transistor, in which the MOS transistor is an eighth n-type field effect transistor having a source grounded, a gate and a drain both connected to a drain of the eighth p-type field effect transistor, or the MOS transistor is a ninth p-type field effect transistor having a source connected to a drain of the eighth p-type field effect transistor, a gate and a drain both grounded; wherein the compensated voltage being taken between the eighth p-type field effect transistor and the MOS transistor.

7. The reference circuit according to claim 6, wherein the voltage output circuit further comprises a third resistor connected between the eighth p-type field effect transistor and the MOS transistor, or connected between the MOS transistor and the ground, or connected between the gate and drain of the eighth n-type field effect transistor, and wherein resistance of the third resistor and dimension of the eighth n-type field effect transistor or the ninth p-type field effect transistor can be changed, thereby changing value of the compensated voltage.

8. The reference circuit according to claim 2, further comprising a voltage output circuit having a plurality of field effect transistors for receiving the first reference voltage or the second reference voltage and generating a compensated voltage, wherein the plurality of field effect transistors are operated in saturation region and the compensated voltage increases with threshold voltages of the plurality of field effect transistors to compensate for temperature variations.

9. The reference circuit according to claim 8, wherein the voltage output circuit comprises:

an eighth p-type field effect transistor having a source connected to the power source, and a gate connected to the first reference voltage; and a metal-oxide semiconductor (MOS) transistor, in which the MOS transistor is an eighth n-type field effect transistor having a source grounded, a gate and a drain both connected to a drain of the eighth p-type field effect transistor, or the MOS transistor is a ninth p-type field effect transistor having a source connected to a drain of the eighth p-type field effect transistor, a gate and a drain both grounded; wherein the compensated voltage being taken between the eighth p-type field effect transistor and the MOS transistor.

10. The reference circuit according to claim 9, wherein the voltage output circuit further comprises a third resistor connected between the eighth p-type field effect transistor and the MOS transistor, or connected between the MOS transistor and the ground, or connected between the gate and drain of the eighth n-type field effect transistor, and wherein resistance of the third resistor and dimension of the eighth n-type field effect transistor or the ninth p-type field effect transistor can be changed, thereby changing value of the compensated voltage.

11. The reference circuit according to claim 3, further comprising a voltage output circuit having a plurality of field effect transistors for receiving the first reference voltage or the second reference voltage and generating a compensated voltage, wherein the plurality of field effect transistors are operated in saturation region and the compensated voltage increases with threshold voltages of the plurality of field effect transistors to compensate for temperature variations.

12. The reference circuit according to claim 11, wherein the voltage output circuit comprises:

an eighth p-type field effect transistor having a source connected to the power source, and a gate connected to the first reference voltage; and a metal-oxide semiconductor (MOS) transistor, in which the MOS transistor is an eighth n-type field effect transistor having a source grounded, a gate and a drain both connected to a drain of the eighth p-type field effect transistor, or the MOS transistor is a ninth p-type field effect transistor having a source connected to a drain of the eighth p-type field effect transistor, a gate and a drain both grounded; wherein the compensated voltage being taken between the eighth p-type field effect transistor and the MOS transistor.

13. The reference circuit according to claim 12, wherein the voltage output circuit further comprises a third resistor connected between the eighth p-type field effect transistor and the MOS transistor, or connected between the MOS transistor and the ground, or connected between the gate and drain of the eighth n-type field effect transistor, and wherein resistance of the third resistor and dimension of the eighth n-type field effect transistor or the ninth p-type field effect transistor can be changed, thereby changing value of the compensated voltage.

14. A reference circuit with temperature compensation, comprising:

a bias generation circuit for generating a first reference voltage; and a voltage output circuit including a plurality of field effect transistors for receiving the first reference voltage and generating a compensated voltage; wherein the plurality of field effect transistors are operated in saturation region, and the compensated voltage increases with threshold voltages of the plurality of field effect transistors to compensate for temperature variations, wherein the bias generation circuit comprises;

a first resistor having one terminal grounded;

a first n-type field effect transistor having a source connected to another terminal of the first resistor, a gate and a drain;

a second n-type field effect transistor having a source grounded, a gate and a drain both connected to the gate of the first n-type field effect transistor;

a first p-type field effect transistor having a source connected to a power source, a gate and a drain both connected to the drain of the first n-type field effect transistor;

a second p-type field effect transistor having a source connected to the power source, a gate connected to the gate of the first p-type field effect transistor, and a drain connected to the drain of the second n-type field effect transistor, wherein a gate voltage among the field effect transistor is the first reference voltage.

15. The reference circuit according to claim 14, wherein the bias generation circuit further comprises:

a third n-type field effect transistor having a source and a drain connected between the first n-type field effect transistor and the first p-type field effect transistor; and a fourth n-type field effect transistor having a source, a drain connected between the second n-type field effect transistor and the second p-type field effect transistor, and a gate connected to the drain of the second p-type field effect transistor and a gate of the third n-type field effect transistor.

16. A reference circuit with temperature compensation, comprising:

a bias generation circuit for generating a first reference voltage; and a voltage output circuit including a plurality of field effect transistors for receiving the first reference voltage and generating a compensated voltage; wherein the plurality of field effect transistors are operated in saturation region, and the compensated voltage increases with threshold voltages of the plurality of field effect transistors to compensate for temperate variations, wherein the voltage output circuit comprises:

an eighth p-type field effect transistor having a source connected to the power source and a gate connected to the first reference voltage; and a metal-oxide semiconductor (MOS) transistor, in which the MOS transistor is an eighth n-type field effect transistor having a source grounded, a gate and a drain both connected to a drain of the eighth p-type field effect transistor, or the MOS transistor is a ninth p-type field effect transistor having a source connected to a drain of the eighth p-type field effect transistor, a gate and a drain both grounded; wherein the compensated voltage being taken between the eighth p-type field effect transistor and the MOS transistor.

17. The reference circuit according to claim 16, wherein the voltage output circuit further comprises a third resistor connected between the eighth p-type field effect transistor and the MOS transistor, or connected between the MOS transistor and the ground, or connected between the gate and drain of the eighth n-type field effect transistor, and wherein resistance of the third resistor and dimension of the eighth n-type field effect transistor or the ninth p-type field effect transistor can be changed, thereby changing value of the compensated voltage.

18. The reference circuit according to claim 14, wherein the voltage output circuit comprises:

an eighth P-type field effect transistor having a source connected to the power source, and a gate connected to the first reference voltage; and a metal-oxide semiconductor (MOS) transistor, in which the MOS transistor is an eighth n-type field effect transistor having a source grounded, a gate and a drain both connected to a drain of the eighth p-type field effect transistor, or the MOS transistor is a ninth p-type field effect transistor having a source connected to a drain of the eighth p-type field effect transistor, a gate and a drain both grounded; wherein the compensated voltage being taken between the eighth p-type field effect transistor and the MOS transistor.

19. The reference circuit according to claim 18, wherein the voltage output circuit further comprises a third resistor connected between the eighth p-type field effect transistor and the MOS transistor, or connected between the MOS transistor and the ground, or connected between the gate and drain of the eighth n-type field effect transistor, and wherein resistance of the third resistor and dimension of the eighth n-type field effect transistor or the ninth p-type field effect transistor can be changed, thereby changing value of the compensated voltage.

* * * * *